United States Patent [19]

Gilbert et al.

[11] 4,180,605

[45] Dec. 25, 1979

[54] MULTILAYER RADOME

[75] Inventors: Daniel E. Gilbert, Maple Valley; James R. Lee, Seattle; Ted J. Kramer, Auburn, all of Wash.

[73] Assignee: The Boeing Company, Seattle, Wash.

[21] Appl. No.: 931,660

[22] Filed: Aug. 8, 1978

[51] Int. Cl.[2] ..... G21F 1/06; G21F 1/12

[52] U.S. Cl. ..... 428/76; 250/517; 252/62; 331/94.5 R; 427/163; 428/539; 428/913

[58] Field of Search ..... 350/1.6, 1.7; 250/515, 250/517, 519; 427/154, 163, 164; 428/69, 76, 34, 539, 913; 331/94.5 R; 252/62

[56] References Cited

U.S. PATENT DOCUMENTS

| | | | |
|---|---|---|---|
| 2,877,286 | 3/1959 | Vance et al. | 250/515 X |
| 3,065,351 | 11/1962 | Weinberger et al. | 250/515 |
| 3,179,549 | 4/1965 | Strong et al. | 428/69 |
| 3,192,575 | 7/1965 | Rosenau et al. | 350/3 X |
| 3,503,787 | 3/1970 | Pendse | 428/539 X |
| 3,871,739 | 3/1975 | Poulsen | 427/154 X |
| 3,936,553 | 2/1976 | Rowe | 428/69 X |
| 4,048,978 | 9/1977 | Plumat et al. | 428/34 |
| 4,114,985 | 9/1978 | Friedman | 250/515 X |

*Primary Examiner*—Harold Ansher
*Attorney, Agent, or Firm*—Thomas H. Murray

[57] ABSTRACT

Protection of microwave antennas from incident irradiation from high power lasers is accomplished by placing a protective covering or radome over antenna elements to be protected. The radome is constructed such that it is substantially transparent to electromagnetic radiation in the microwave frequency range and at the same time substantially opaque to electromagnetic radiation in the laser frequency range. The radome is constructed of multilayers of a refractory ceramic material, such as boron nitride and beryllium oxide, spaced apart with the spaces evacuated. When the electromagnetic radiation from a high power laser strikes the radome of this invention, the opaqueness to the laser energy causes a conversion to heat energy which is then insulated from sensitive antenna elements by the evacuated spaces separating the refractory ceramic layers.

4 Claims, 3 Drawing Figures

MULTILAYER RADOME

BACKGROUND OF THE INVENTION

1. Field of the Invention:

This invention relates to the protection of antennas employed in conjunction with sophisticated communications equipment, in particular military communications equipment. By enclosing antennas within shields known as radomes, significant protective attributes can be developed. Radomes are used to protect antennas from adverse environmental effects; to provide a specific geometry, as would be necessary in air or water craft; and to avoid detection by electronic sensing equipment through absorption or scattering of the electromagnetic radiation employed by the sensing equipment. With the advent of modern threat levels employing high power lasers capable of producing electromagnetic radiation of sufficient intensity to melt most types of metals and some ceramic materials, a radome capable of protecting antennas from the high thermal fluxes associated with high power lasers is required. This invention relates to radomes providing that protection.

2. Description of the Prior Art:

The concept of radomes is not new in the art. The protection afforded antennas has varied from a simple coating designed to resist the adverse environmental effects likely to be found in a hostile military situation to a radome designed to prevent detection of antennas by sophisticated electronic sensing equipment. None of the prior art examined, however, addresses the problems associated with laser damage or destruction in a hostile environment.

In U.S. Pat. No. 3,871,739, there is disclosed an improved protective window used to protect against high energy radiation sources. This invention relates to reflecting the infrared radiation while transmitting visible light. The invention is directed to preventing localized overheating which can occur due to absorption rather than reflection of high energy infrared radiation. The absorption is due to dust or dirt which can collect on the window. This invention is concerned with improving the reflective characteristics of the protective window as the means for preventing overheating and does not suggest a solution to the problem of providing continuing protection to antennas which require opaqueness to high power laser irradiation and transparency to microwave irradiation.

SUMMARY OF THE INVENTION

This invention, known as a radome, relates to a device designed to protect antennas from incident irradiation from high power lasers. Specifically, this invention provides protection from high power lasers by covering antennas, such as the type used by the Armed Forces for local and long distance communications, with a refractory ceramic structure. The refractory ceramic structure comprises multiple layers of a refractory ceramic material which is substantially opaque to electromagnetic radiation in a first predetermined range and substantially transparent to electromagnetic radiation in a second predetermined range. The multiple layers of refractory ceramic material are in spaced relation with the spaces between the layers evacuated. When the radome is struck by incident irradiation, for example, from a high power laser, the opaqueness of the refractory ceramic material causes the energy from the laser beam to be absorbed and converted to heat energy. This heat energy is then prevented from damaging the antenna by the thermal insulation provided by the evacuated spaces. By experimentation and modeling, it has been discovered that various combinations of thicknesses and layers will accomplish the required protection. It has been discovered that a minimum of three layers is required, two refractory ceramic layers and one evacuated layer, to provide the necessary protection within the first range while remaining substantially transparent in the second range. The number of layers required and the thickness of the layers may be varied depending upon the location and type of equipment requiring protection. For example, weight may restrict the number and thickness of the refractory ceramic layers in satellite applications. The refractory ceramic materials which have been found suitable for use in this invention are boron nitride and beryllium oxide.

The objects and advantages of this invention will be more completely disclosed and described in the following specification, the accompanying drawings and the appended claims.

BRIEF DESCRIPTION OF THE DRAWINGS

Referring to the drawings in detail, FIGS. 1, 2 and 3 illustrate techniques for employing the multilayer radome of the invention. Each figure shows a parabolic reflector antenna 1 protected by a multilayer radome 2 and subjected to electromagnetic radiation 10 from a high power laser source. FIG. 1 illustrates a multilayer radome 2 that is placed over the complete antenna structure 1. FIG. 2 illustrates the same antenna 1 protected by a multilayer radome 2 which is attached to the transmitting portion of the antenna. FIG. 3 illustrates the same antenna 1 protected by a multilayer radome 2 applied to the surfaces of the antenna. FIG. 4 illustrates a fragmentary sectional view of a multilayer radome 2 which comprises layers of refractory ceramic material 3 spaced apart by evacuated spaces 4. It would be obvious to one skilled in the art to use any suitable refractory ceramic material, for example, boron nitride or beryllium oxide. Table I illustrates a specific embodiment employing boron nitride and beryllium oxide in alternating layers.

TABLE I

MULTILAYER BORON NITRIDE AND BERYLLIUM OXIDE RADOME

| LAYER | MATERIAL | THICKNESS MIN | THICKNESS MAX | THICKNESS DESIGN |
|---|---|---|---|---|
| 1 | Boron Nitride | 0.0300 | 0.0300 | 0.0300 |
| 2 | Vacuum | 0.0050 | 0.2500 | 0.1133 |
| 3 | Beryllium Oxide | 0.0300 | 0.0300 | 0.0300 |
| 4 | Vacuum | 0.0050 | 0.2500 | 0.0407 |
| 5 | Boron Nitride | 0.0300 | 0.0300 | 0.0300 |
| 6 | Vacuum | 0.0050 | 0.2500 | 0.0407 |
| 7 | Beryllium Oxide | 0.0300 | 0.0300 | 0.0300 |
| 8 | Vacuum | 0.0050 | 0.2500 | 0.1133 |

TABLE I-continued

| MULTILAYER BORON NITRIDE AND BERYLLIUM OXIDE RADOME | | | | |
|---|---|---|---|---|
| | | THICKNESS | | |
| LAYER | MATERIAL | MIN | MAX | DESIGN |
| 9 | Boron Nitride | 0.0300 | 0.0300 | 0.0300 |

The boron nitride layers can be constructed using techniques known to those skilled in the art, such as vapor deposition or hot-pressed techniques. Beryllium oxide layers can be constructed using known hot-pressed techniques. After construction of the refractory ceramic layers 3 as described above and in a shape designed to cover the antenna rquiring protection, the layers 3 are placed in spaced relation and the spaces 4 are evacuated in a manner known in the evacuation art. The radome is then placed over or attached to the antenna.

Figure 1:
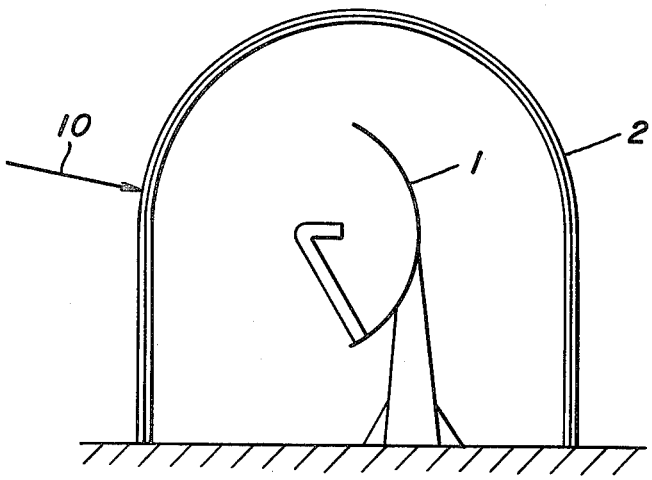
FIG. 1 is a diagrammatic illustration of a parabolic reflector antenna inside a multilayer radome.
Figure 2:
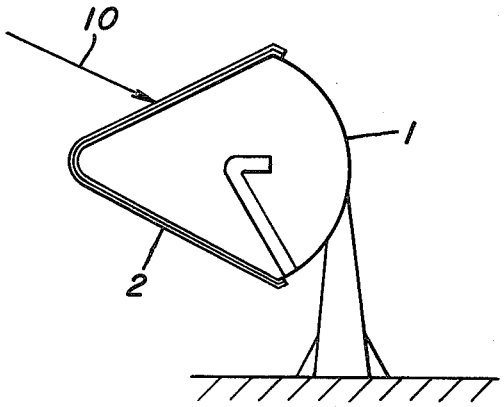
FIG. 2 is a diagrammatic illustration of a parabolic reflector antenna with a multilayer radome attached.
Figure 3:
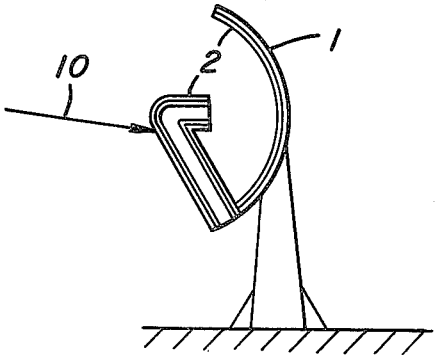
FIG. 3 is a diagrammatic illustration of a parabolic reflector antenna with multilayer radome coated surfaces.
Figure 4:
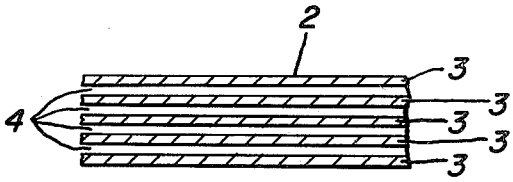
FIG. 4 is a fragmentary sectional view of a multilayer radome.
Figure 5:
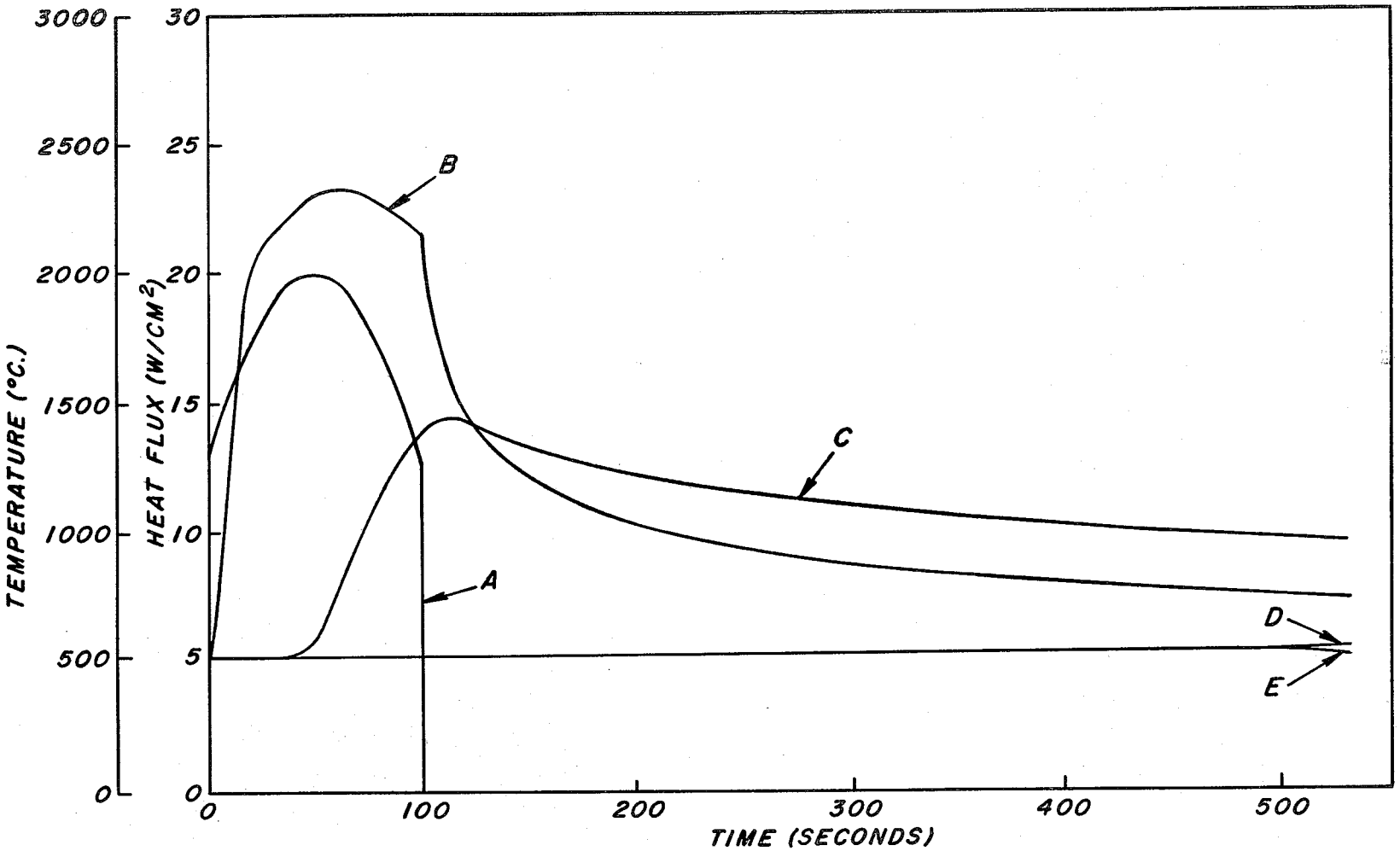
FIG. 5 is a graph illustrating thermal characteristics of a multilayer radome.

Upon exposure to high energy electromagnetic radiation, such as that in the laser range, the outer layer of refractory ceramic material prevents substantially all of the electromagnetic radiation from passing. This opaqueness causes a transformation of energy from electromagnetic radiation to heat energy. This heat energy is then subject to transfer by conduction, convection and/or radiation. Since the layer adjacent to the refractory ceramic material is a vacuum, there can be no transfer by convection or conduction although an insignificant portion of the heat energy can be transferred at the points where the layers are joined by conduction. Radiation, however, does cause a transfer across the vacuum layer to the next refractory ceramic layer. This continues through the radome with each layer being heated less than the preceding one because of the inefficiency of the radiant transfer. FIG. 5 illustrates this protective capability upon exposure to electromagnetic radiation from high power lasers by showing the temperature distribution throughout a specific embodiment of a multilayer radome comprising boron nitride layers as defined in Table II below.

TABLE II

| MULTILAYER BORON NITRIDE RADOME CONFIGURATION | | |
|---|---|---|
| LAYER | MATERIAL | THICKNESS (Inches) |
| 1 | Boron Nitride | 0.0237 |
| 2 | Vacuum | 0.01 |
| 3 | Boron Nitride | 0.0185 |
| 4 | Vacuum | 0.01 |
| 5 | Boron Nitride | 0.0082 |
| 6 | Vacuum | 0.01 |
| 7 | Boron Nitride | 0.0300 |

TABLE II-continued

| MULTILAYER BORON NITRIDE RADOME CONFIGURATION | | |
|---|---|---|
| LAYER | MATERIAL | THICKNESS (Inches) |
| 8 | Vacuum | 0.01 |
| 9 | Boron Nitride | 0.0189 |
| 10 | Vacuum | 0.01 |
| 11 | Boron Nitride | 0.0209 |
| 12 | Vacuum | 0.01 |
| 13 | Boron Nitride | 0.0182 |
| 14 | Vacuum | 0.01 |
| 15 | Boron Nitride | 0.02998 |
| 16 | Vacuum | 0.01 |
| 17 | Aluminum Substrate | 0.250 |

The temperature rise on the surface layer, curve B, of boron nitride is induced by the high thermal flux, curve A, produced when electromagnetic radiation from a high power laser strikes the multilayer radome and is converted from electromagnetic radiation to heat by the opaqueness of the boron nitride. The radiant transfer which occurs heats each succeeding layer less than the one before. Curve C illustrates the heating which occurs in the mid-layer of boron nitride, curve D the bottom layer of boron nitride and curve E the aluminum substrate. Insulation of the antenna from this heat buildup is provided by the evacuated spaces 4 between the boron nitride layers 3. As illustrated in FIG. 5, essentially none of the induced thermal energy reaches the aluminum substrate or the antenna protected by the multilayer radome 2.

Although the invention has been shown in connection with certain specific embodiments, it will be readily apparent to those skilled in the art that various changes in thickness, materials and number of layers may be made to suit requirements without departing from the spirit and scope of the invention.

We claim as our invention:

1. A radome for protection of antennas subject to damage from incident irradiation which comprises a plurality of boron nitride layers in spaced relation with spaces between the layers evacuated.

2. A radome for protection of antennas subject to damage from incident irradiation which comprises a plurality of alternating layers of boron nitride and beryllium oxide in spaced relation with spaces between the layers evacuated.

3. The radome as recited in claims 1 or 2 wherein the layers are substantially transparent to electromagnetic radiation in a first predetermined range and substantially opaque to electromagnetic radiation in a second predetermined range wherein said opaqueness transforms the incident irradiation into heat which is thermally insulated from the antenna by the evacuated spaces.

4. The radome as recited in claim 3 wherein the first predetermined range is the microwave range and the second predetermined range is the laser range.

* * * * *